US011808001B2

(12) United States Patent
Ledwith et al.

(10) Patent No.: US 11,808,001 B2
(45) Date of Patent: Nov. 7, 2023

(54) FOUNDATION SYSTEM

(71) Applicant: Alan Ledwith, Navan (IE)

(72) Inventors: Alan Ledwith, Navan (IE); Andrew Hammelmann, Killybegs (IE)

(73) Assignee: Terratonics Limited, County Meath (IE)

( * ) Notice: Subject to any disclaimer, the term of this patent is extended or adjusted under 35 U.S.C. 154(b) by 59 days.

(21) Appl. No.: 17/295,839

(22) PCT Filed: Nov. 19, 2019

(86) PCT No.: PCT/EP2019/081857
§ 371 (c)(1),
(2) Date: May 20, 2021

(87) PCT Pub. No.: WO2020/104489
PCT Pub. Date: May 28, 2020

(65) Prior Publication Data

US 2022/0018083 A1 Jan. 20, 2022

(30) Foreign Application Priority Data

Nov. 21, 2018 (IE) ..... S2018/0511

(51) Int. Cl.

| | |
|---|---|
| ***E02D 27/01*** | (2006.01) |
| ***E04B 1/00*** | (2006.01) |
| ***E04B 5/14*** | (2006.01) |
| ***E02D 27/48*** | (2006.01) |

(52) U.S. Cl.
CPC ..... *E02D 27/01* (2013.01); *E04B 1/0007* (2013.01); *E04B 5/14* (2013.01); *E02D 27/48* (2013.01)

(58) Field of Classification Search
CPC ..... E02D 27/01; E02D 27/48; E02D 35/005; E04B 1/0007; E04B 5/14
USPC ..... 52/126.6
See application file for complete search history.

(56) References Cited

U.S. PATENT DOCUMENTS

| | | | | |
|---|---|---|---|---|
| 3,470,663 | A * | 10/1969 | Tate | E04F 15/02482 52/126.6 |
| 3,713,259 | A * | 1/1973 | Tkach | E04B 1/34342 248/354.3 |
| 4,899,497 | A | 2/1990 | Madl, Jr. | |
| 4,918,891 | A | 4/1990 | Gerszewski | |
| 5,151,108 | A | 9/1992 | Kitahara et al. | |
| 5,425,214 | A * | 6/1995 | Truelove | E04B 5/02 52/762 |
| 5,595,366 | A | 1/1997 | Cusimano et al. | |

(Continued)

FOREIGN PATENT DOCUMENTS

| | | | | |
|---|---|---|---|---|
| JP | 2004135819 | A * | 5/2004 | F16B 12/44 |
| KR | 101661421 | B1 * | 9/2016 | E04F 15/02 |

(Continued)

*Primary Examiner* — Brian D Mattei
*Assistant Examiner* — Omar F Hijaz
(74) *Attorney, Agent, or Firm* — Bookoff McAndrews, PLLC

(57) ABSTRACT

A support stand (2) and a foundation system (1) for a building comprising the support stand (2) attachable to a structural beam (3) in which the support stand (2) comprises a pedestal (6) and a beam carrier (7) mounted on the pedestal (6) wherein the beam carrier (7) comprises a wingnut construction defining at least one substantially vertical wing (19,33) connectable with a structural beam (3).

12 Claims, 19 Drawing Sheets

(56) References Cited

U.S. PATENT DOCUMENTS

| | | | | |
|---|---|---|---|---|
| 5,862,635 | A | 1/1999 | Linse et al. | |
| 7,610,728 | B1 | 11/2009 | Manocchia | |
| 7,918,059 | B2 * | 4/2011 | Repasky | E04F 15/02183 52/126.6 |
| 2004/0261329 | A1 * | 12/2004 | Kugler | E04F 15/0247 52/126.6 |
| 2009/0071084 | A1 * | 3/2009 | Johansson | E04F 15/0247 52/126.6 |
| 2009/0084046 | A1 * | 4/2009 | McConnell | E04F 15/02429 52/366 |
| 2010/0031587 | A1 * | 2/2010 | Weeks | E04C 3/07 52/126.6 |
| 2014/0237912 | A1 * | 8/2014 | Kugler | E04F 15/02464 52/126.6 |

FOREIGN PATENT DOCUMENTS

| | | | | |
|---|---|---|---|---|
| WO | WO-2004081293 | A2 * | 9/2004 | E02D 27/01 |
| WO | 2006076391 | A2 | 7/2006 | |

* cited by examiner

FOUNDATION SYSTEM

INTRODUCTION

This invention relates to a foundation system for a building and to a support stand for use in the foundation system.

BACKGROUND OF THE INVENTION

Modern methods of construction (MMC) have been developed in recent years to speed construction methods and produce environmentally friendly and sustainable buildings. Examples of MMC's include timberframe, light gauge steel frame (LGSF), structural insulated panel (SIP), cross-laminated timber (CLT)/Xlam, laminated log, passive build and modular build construction methods. However, despite these advances, MMC's are still generally reliant on concrete for their base and cladding.

Accordingly, while many countries suffer from housing, pollution and water challenges and MMC's can assist in addressing such problems, cement is still one of the core materials employed in building a foundation for most builds with consequent negative environmental impacts. For example, concrete alone produces 8% of the world's carbon dioxide emissions. Moreover, along with releasing $CO_2$ into the atmosphere, concrete production is responsible for using vast amounts of water and it has been estimated that during the next 35 years, 2,300-2,800 $km^3$ of water will be withdrawn by the concrete industry—a figure which does not include the water required to clean the cement plants and associated equipment.

Accordingly, concrete is an enormous polluter of the planet while its use in the construction of a typical house

- Significantly increases construction lead times by on average 30 days
- Increases cost by up to 30%
- Pumps large quantities of $CO_2$ into the atmosphere (300 $m^3$ per 1 $m^2$ of floor area)
- Requires over 10000 litres of water to build an average house to ground floor level
- Requires up to 10 truck deliveries to site to get to floor level
- Exacerbates flooding by displacement (0.5 $m^3$ per $m^2$ of floor area)
- Intensifies damage caused by seismic activity
- Creates substantial amounts of sub soil waste (up €50 per $m^3$)
- Limits land usage for development because of its weight.

Moreover, the use of concrete, whether in foundations or above ground, impacts on a number of key elements in the construction process such as Time (onsite, extensive programme, sequential process phase reliant, trade counter, curing, drying, weather dependent and modifications), Energy (manufacture, transportation, onsite plant requirements, drying and modifications, Materials (large variety required, high volumes, complex pricing, supply reliant), Labour (intensive, high skill, reliability and high cost), Health & Safety (manual handling, onsite fabrication, complex operations, poor structural integrity, and longer time/higher risk), Land (firm ground required, must be flood free and accessible), Waste (due to poor workmanship, over order risks, under order risks, cut offs, excavations soil disposal, damages, storage and theft.

Many countries such as Ireland also suffer from housing shortages but new home developments generally fall well short of demand with the use of old construction methods contributing significantly to the shortfall by being very labour intensive and time consuming.

In summary, new domestic and commercial building developments, even when using MMC's, still suffer from a number of problems such as being labour intensive, environmentally damaging, weather reliant, skill reliant, and costly while the need to address the sub-structure when considering the environment of the foundation and ground floor can significantly impact on construction in terms of time and cost.

Various systems have been developed to replace concrete foundation systems. For example, steel piles such as auger screw, hammer driven or hydraulic press driven piles can be used in foundation systems together with steel or concrete ring beams. Such pile-type foundation systems are generally used in poor ground conditions and suffer from a number of disadvantages. For example, the materials used are usually made from galvanised steel (which is not considered a green material) and only has a lifespan of 60 to 80 years in the ground. However, loss in structural integrity may occur sooner or later depending on ground conditions such as moisture and acidity/alkalinity. Most steel pile systems also require welding which removes the galvanised coating and can only be painted over on site drastically reducing the corrosion protection so that rust soon develops. Welding also weakens high tensile steel which can lead to structural compromise, is time consuming, requires skilled personnel and can lead to fire risks.

Although pile systems can be quicker than traditional concrete systems, they can also have some added delays e.g. setting out needs to be pin point accurate. Piles can also bend or take longer than expected to reach full penetration. Any piles which don't reach their full depth must also be trimmed back. Accuracy of alignment and levels can be problematical as the pile plates can move when the piles are driven while, in general, such pile systems cannot be adjusted.

In addition, when the piles are driven into the ground they can hit services such as electric gas leading to high risk of injury along and increased costs. As the piles and substructure are firmly anchored to the ground, buildings receive full shockwaves during seismic events that can lead to failure. Piles also require pneumatic or hydraulic hammering which can create dangerous and undesirable noise pollution. Driving piles can also create shock waves in the ground resulting in damage to adjacent buildings due to soil subsidence or water fraction movement.

U.S. Pat. Nos. 5,862,635, 5,595,366, 4,899,497, 5,151,108 and 4,918,891 all describe building support stands for securing buildings to a foundation in which beams can be mounted between the support stands on which the building is formed. However, the known stands are formed from perishable materials such as reinforced concrete and/or steel or are made up of complex interconnected components that must be assembled with brackets, fixings and the like before or during use. In addition, the known support stands require the use of labour intensive and complex fixings to secure the beams to the support stands.

An object of the invention is to overcome at least some of the problems of the prior art.

SUMMARY OF THE INVENTION

According to the invention there is provided a foundation system for a building comprising:

- a support stand attachable to a structural beam,
- the support stand comprising a pedestal and a beam carrier mounted on the pedestal wherein the beam carrier comprises a wingnut construction defining at least one substantially vertical wing connectable with a structural beam.

Preferably, the beam carrier is threadedly mounted on the pedestal to define a beam carrier height adjustment mechanism on the support stand. More preferably, the beam carrier is threadedly mounted on the pedestal at an insert disposed between the beam carrier and the pedestal. Most preferably, the insert is threaded.

In one embodiment, the beam carrier comprises a substantially horizontal structural beam support plate at each vertical wing.

Preferably, the support stand comprises two or more vertical wings disposed at 90° to each other. Suitably, the support stand comprises three vertical wings disposed at 90° to each other. In one embodiment, the support stand comprises four vertical wings disposed at 90° to each other to define a cruciform shaped beam carrier. Suitably, the wing comprises holes for receiving structural beam fixings.

In one embodiment, the beam carrier comprises an offset beam carrier. Suitably, the offset beam carrier comprises an outside offset beam carrier. Alternatively, or in addition, the beam carrier comprises an inside offset beam carrier.

Advantageously, the offset beam carrier comprises a slot-like or U-shaped channel for receiving a beam.

Preferably, the pedestal comprises a base. Optionally, the base comprises holes for receiving a rod or pin. Suitably, the holes are angled in the base.

In one embodiment, the pedestal comprises a threaded pillar. Preferably, the beam carrier is threadedly mounted on the pillar so that the beam carrier is movable between a raised and lowered position by the beam carrier height adjustment mechanism.

In one embodiment, the support stand further comprises a secondary or fine beam carrier height adjustment mechanism.

Preferably, the support stand comprises a composite polymer material. More preferably, the support stand comprises Nyrim (Trade Mark).

Suitably, the foundation system further comprises at least one structural beam.

Preferably, the structural beam comprises an engineered end for securing the structural beam to the wing. More preferably, the engineered end comprises a mortise-like engineered end for receiving the wing.

Suitably, the structural beam comprises a double structural beam in which each beam is disposable either side of the wing at the engineered ends.

Optionally, the structural beam can be selected from the group consisting of a structural composite lumbar beam, a structural open web double beam, a structural double I-beam, a structural double timber plank/joist/fletch beam and a structural double light gauge steel beam.

Preferably, the foundation system further comprises a deck for a floor structure. More preferably, the deck comprises a cassette type deck.

Optionally, the foundation system comprises a plinth for tying structural beams and/or the floor structure to the ground. Preferably, the plinth is L-shaped. Suitably, plinth comprises air vents.

In another embodiment, the invention also extends to a support stand for supporting a structural beam in a foundation system comprising a pedestal and a beam carrier mounted on the pedestal wherein the beam carrier comprises a wingnut construction defining at least one substantially vertical wing connectable with a structural beam.

Preferably, the beam carrier is threadedly mounted on the pedestal to define a beam carrier height adjustment mechanism on the support stand. More preferably, the beam carrier is threadedly mounted on the pedestal at an insert disposed between the beam carrier and the pedestal. Most preferably, the insert is threaded.

In one embodiment, the beam carrier comprises a substantially horizontal structural beam support plate at each vertical wing.

Preferably, the support stand comprises two or more vertical wings disposed at 90° to each other. Suitably, the support stand comprises three vertical wings disposed at 90° to each other. In one embodiment, the support stand comprises four vertical wings disposed at 90° to each other to define a cruciform shaped beam carrier.

Suitably, the wing comprises holes for receiving structural beam fixings.

Preferably, the pedestal comprises a base. Optionally, the base comprises holes for receiving a rod or pin. Suitably, the holes are angled in the base.

In one embodiment, the pedestal comprises a threaded pillar. Preferably, the beam carrier is threadedly mounted on the pillar so that the beam carrier is movable between a raised and lowered position by the beam carrier height adjustment mechanism.

In one embodiment, the support stand further comprises a secondary or fine beam carrier height adjustment mechanism.

Preferably, the support stand comprises a composite polymer material. More preferably, the support stand comprises Nyrim (Trade Mark).

In a further embodiment, the invention also extends to a method for constructing a foundation comprising employing a foundation system or support stand as hereinbefore defined in the construction of the foundation.

The foundation of system of the invention is an environmentally friendly rapid foundation system that obviates the need for concrete foundations whilst facilitating rapid and sustainable construction of domestic and commercial buildings. The foundation system of the invention is suitable for use with all MMC's including timberframe, light gauge steel frame, structural insulated panel, CLT/Xlam, laminated log, passive build and modular build methods.

The foundation system of the invention is a fast, strong, green and a cost-effective construction method that significantly reduces construction lead times and is up to 8 times faster than traditional cement foundations and reduces $CO_2$ emissions by up to over 90% in buildings' bases by eliminating concrete requirements. Moreover, as concrete is not required, no water is needed saving up to 8,000 of litres of drinking quality water per average house build.

The foundation system of the invention also allows construction on low level land which would usually be considered otherwise unsuitable for construction without considerable civil engineering works in or near flood plains. The foundation system also reduces impact damage to building structures due to floods and diminishes the lateral forces associated with earthquakes whilst also reducing excavation and subsoil waste disposal by up to 100%.

The invention also saves up to 25% of overall build costs, ensures completion in up to 80% less time as a traditional build, improves environmental impact by cleaner efficiencies as no water is required and critically, the foundation system of the invention is not weather dependent unlike conventional construction methods employing concrete foundations.

Accordingly, the foundation system of the invention addresses constraints associated with using concrete for a build foundation as follows:

- reduces foundation construction time (to ground floor level) from about 1 month with concrete to 2-4 days;
- reduces energy requirements e.g. cement production requires temperatures of 1000° C. while the support stand, structural beams and other elements of the foundation system of the invention can be manufactured with comparatively minimal manufacturing energy requirements;
- unlike labour intensive blocks which can weigh 20 kg or more and bags of cement which can weigh 25 kg or more together with associated heavy lifting and shovelling of concrete which can all lead to health issues, the foundation system of the invention is light and easy to handle and requires less repetitive movements than shovelling or block laying. The foundation system of the invention is also clean and free of irritants for the installation technicians;
- the installation process is easy to follow by any trades or competent person following training;
- the foundation system is not weather dependent—concrete can only be laid when conditions are right i.e. dry and temperate conditions whereas the system of the invention is not weather dependent;
- traditional masonry construction requires numerous deliveries to and from a site adding to environmental damage e.g. on average 27 truck loads are required for an average detached house. However, with the system of the invention it is estimated that the number of site deliveries can be halved;
- traditional masonry construction is not suitable for all site conditions due to its high mass and the resulting pressure in places on the ground resulting in restrictions on building in some areas which suffer from poor/soft ground conditions thus increasing house prices as firm ground land can be in short supply especially near coastal regions where demand for houses is high. In contradistinction, the foundation system of the invention coupled with a timber frame building will weigh 5-5 times less than a traditional masonry building which places far less weight on the ground reducing the need for very favourable firm ground;
- traditional construction methods use vast amounts of stone aggregates and cement which adds to the environmental impact whereas the foundation system of the invention greatly reduces the volume of materials required by a factor of 3 times per average build;
- concrete based construction methods require deep excavations of subsoil which must be moved to landfill. The removed soil may also require double or treble handling on site before removal leading to increased emissions and environmental impact locally. In contrast, the foundation system of the invention only requires the topsoil to be excavated which can be reused for landscaping.

The height adjustable beam carrier of the wingnut-like support stand of the invention holds and supports structural beams and the load acting on the structural beams. Any suitable structural beams can be employed in the foundation system of the invention such as single structural beams having engineered ends e.g. mortised or slotted engineered ends beam or double structural beams running parallel to each other (side by side). The structural beams are supported on beam support plates on the wingnut like beam carrier and secured to the beam carrier at the vertical wings by simple mechanical fixings such as screws, bolts, dowels and the like.

The foundation system of the invention in combination with an engineered crushed stone base forms a rigid grid foundation/base structure on top of which buildings can be constructed.

The engineered ground is typically ground which has been cleared of its top soil and which is then covered in layer/layers of hard crushed stone aggregate, which is then compacted to the site specific requirements. The engineered ground can be furthered strengthened by the addition of layer/layers of geo grid or geo textile as required by site specific requirements determined by structural design engineers and the like.

As the support stand is formed from a composite engineering polymer material such as Nyrim (Trade Mark), the support stand has longevity and does not corrode or perish in or above ground. The support stand can also be recycled.

The foundation system of the invention also obviates cutting, welding or fabrication on site as all components are fixed with simple mechanical fixings such as dowels or bolts.

The foundation system of the invention can sit directly on the ground and need not be anchored in any way while the support stands dissipate energy through their high flexural strength.

The foundation system of the invention also facilitates quiet construction while the engineered ground requires minimal vibrations so risk of structural damage is greatly mitigated.

The support stand of the invention also enjoys high strength due to its wingnut like configuration e.g. can be rated from 10 tonnes to a maximum load of 20 tonnes which can be scaled up or down as required. In addition, the height adjustability can be varied as required with an adjustability of about 200 mm being typical.

The system of the invention relies on ground pressure to remain anchored but can also be anchored with geogrid followed by crushed stone being placed over the base of the support stand if desired whereas known structures generally require embedding or anchoring. Accordingly, the system of the invention takes advantage of the natural load capacity of a crushed stone base which can be further enhanced by the addition of geogrids or similar if desired.

The foundation system of the invention can be used in the construction of domestic, industrial and commercial buildings such as houses, data centres, pharmaceutical facilities, hospitals, hotels, retail, drive through restaurants, pods, garages, decks, stages, bridges, playground structures and the like.

BRIEF DESCRIPTION OF THE DRAWINGS

FIG. 2(*b*) is a side elevation of the support stand of FIG. 2(*a*);

FIG. 2(*c*) is a longitudinal cross-section through the support stand of FIG. 2(*b*);

FIG. 2(*d*) is a top plan view of the support stand;

DETAILED DESCRIPTION OF THE INVENTION

Figure 1:
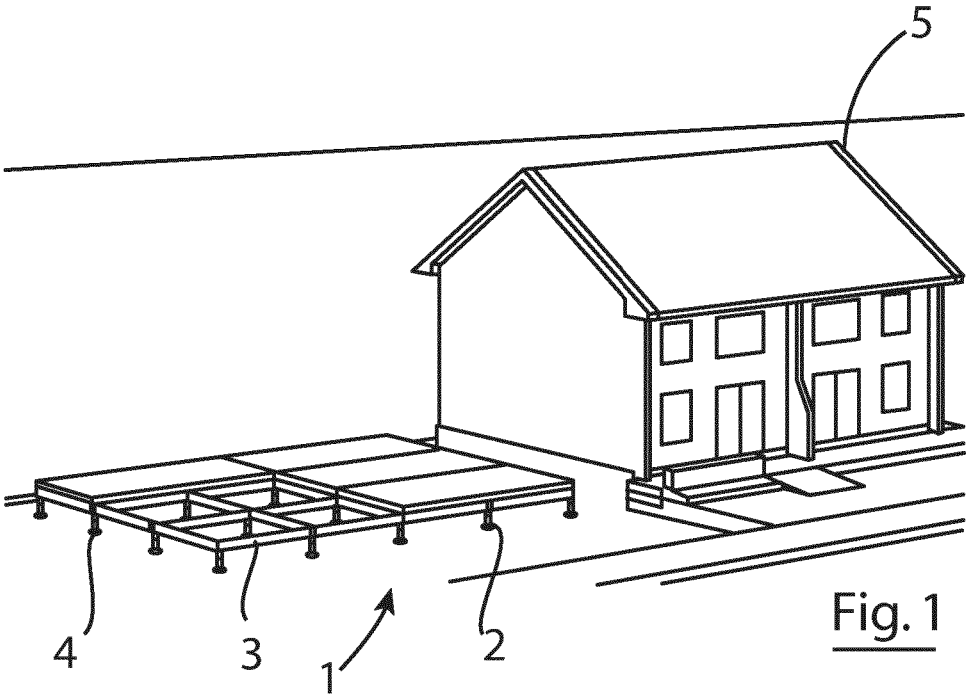
FIG. 1 is a perspective view from above and one side of a first embodiment of a foundation system of the invention in-situ in which the support stands of the invention are arranged in a grid formation on engineered ground and structural beams are secured in the support stands to form a rigid structural support frame for receiving a cassette or deck-like floor structure on which a building is constructed.
Figure 2B:
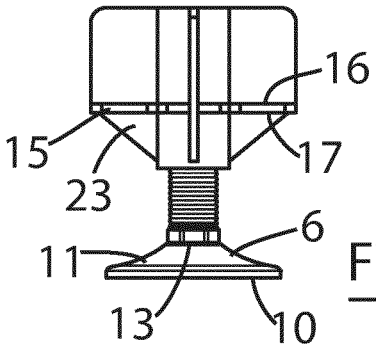
FIG. 2(*a*) is a perspective view from above and one side of a first embodiment of the support stand of the foundation system of FIG. 1.
Figure 2C:
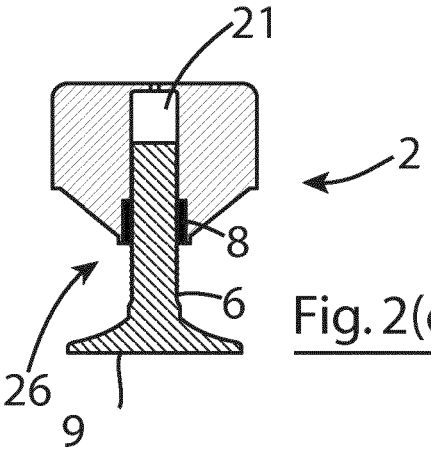
Figure 2D:
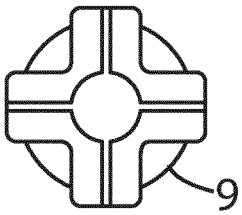
Figure 2A:
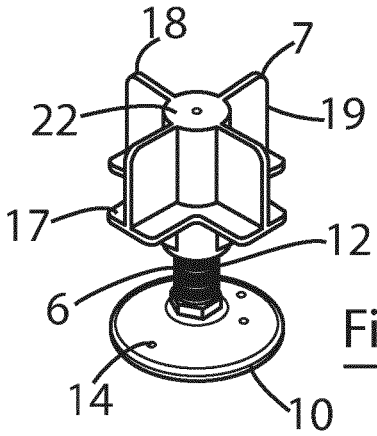

FIG. 1 of the drawings shows a first embodiment of a foundation system 1 of the invention. Generally, the foundation system 1 is made up height adjustable wingnut-like support stands 2 which can be arranged in a grid formation on engineered ground and structural beams 3 secured in the support stands 2 to form a rigid structural support frame for receiving a cassette or deck-like floor structure 4 on which a building 5 can be constructed.

As shown particularly in FIGS. 2 to 5, a first embodiment of the wingnut-like support stands 2 is made up of a ground engaging pedestal 6 and beam carrier 7 mounted on the pedestal 6 in a height adjustable manner at a threaded sleeve insert 8 disposed between the pedestal 6 and the beam carrier 7. The threaded sleeve insert 8 can be mated to the beam carrier 7 by an interference fit combined with adhesive. The insert 8 transmits the load from the structural beam 3 to the pedestal 6.

The pedestal 6 has a circular base or pad 9 defining a bottom face 10 for engaging with the ground and an upper top face 11 on which a threaded pillar 12 is centrally mounted on the circular base 9. The threaded pillar 12 is attached to the circular base 9 at a beam carrier height adjustment nut 13. The circular base 9 serves to support the support stand 2 on the ground in use and is also provided with generally circumferentially spaced apart rod or pin holes 14 for receiving elongate rods to fix the circular base 9 to the ground if desired. The pedestal 6 transmits the associated structural loads from its location to the engineered ground below the building 5.

In the present embodiment, the height adjustable beam carrier 7 of the support stand 2 is made up a cruciform horizontal base plate 15. A top face 16 of the base plate 15 defines four horizontal beam support plates 17 disposed at 90° with respect to each other in the cruciform shape so that each beam support plate 17 can support a structural beam 3. Each beam support plate 17 is provided with a beam connector 18 in the form of a web-like vertical uprights or wings 19 to which structural beams can be secured at fixing openings 20 defined in the web-like uprights or wings 19. The beam carrier 7 is further provided with a central bore 21 defined in a substantially cylindrical housing 22 centrally located between the beam support plates 17 and the beam connectors 18 in a wingnut configuration. As shall be explained more fully below, the central bore 21 is configured to receive the sleeve insert 8.

On its underside, the horizontal base plate 15 is provided with reinforcing supports 23 which extend between the base plate 15 and a central housing bottom portion 24 contiguous with the central housing 22. The central housing bottom portion 24 defines a pillar opening 25 for receiving the threaded pillar 12 in the central bore 21.

The beam carrier 7 is placed on the threaded pillar 12 of the pedestal 6 by inserting the threaded pillar 12 in the central bore 21 via the pillar opening 25 with the threaded sleeve insert 8 disposed between the beam carrier 7 and the threaded pillar 12 so that the beam carrier 7 can be moved upwards and downwards with respect to the pedestal 6 in a height adjustable manner. Accordingly, the support stand 2 is provided with a primary beam carrier height adjusting mechanism 26.

Figure 3:
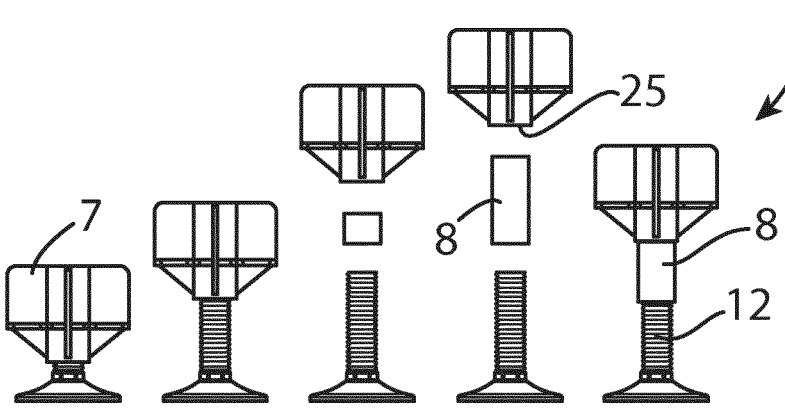
FIG. 3 is a side elevation of the support stand with the beam carrier and the sleeve insert of the support stand in various positions with respect to the threaded pillar together with sleeve inserts of various lengths so that the height adjustability of the beam carrier can be increased or decreased in accordance with the size of the insert.
Figure 4:
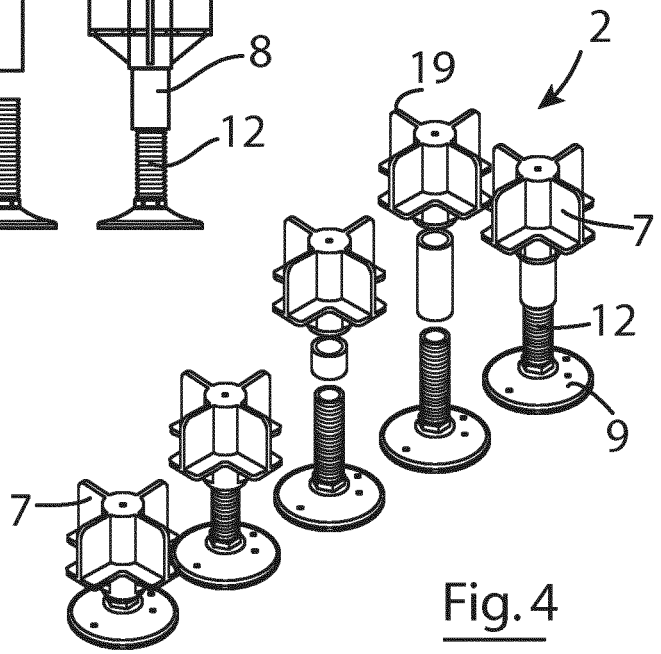
FIG. 4 is a perspective view from above and one side of the support stands of FIG. 3.
Figure 5:
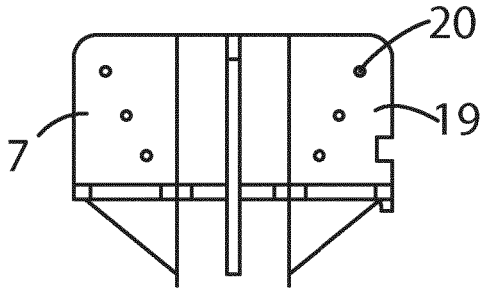
FIG. 5 is an enlarged side elevation of the wing-like vertical beam connector plates of the support stand.

As shown in FIGS. 3 and 4, the height adjustability of the support stand 2 can be varied as required by varying the length of the threaded sleeve insert 8 so that movement of the beam carrier on the threaded pillar can be varied. Accordingly, the insert 8 can be made to different lengths depending on customer requirements for finished floor height.

In the present embodiment, the support stand 2 is cruciform in shape with four beam support plates 17 and associated beam connectors 18. However, in other embodiments, the support stand can have other numbers of support plates 17 and beam connectors such as two perpendicularly disposed support plates 17/beam connectors 18 for supporting perpendicularly disposed structural beams 3 or three support plates 17/beam connectors 18 disposed at 90° to each other for supporting three structural beams 3 at a corner in a grid formation. This is described in more detail in FIGS. 28 to 35.

The support stand 2 serves as the load bearing element between the ground and a building 5 while the pedestal 6 can be a one piece moulded composite polymer consisting of the base 9 and the threaded pillar 12 for supporting the required load. The beam carrier 7 is also a one piece moulded composite polymer. The winged nut configuration of the beam carrier 7 facilitates the carrying of the structural beams 3 in a 90° arrangement allowing for a rapid aligned and level grid structure of beams 3 to be erected.

The support stands 2 can be sized as required to accommodate individual building design requirements.

Figure 6:
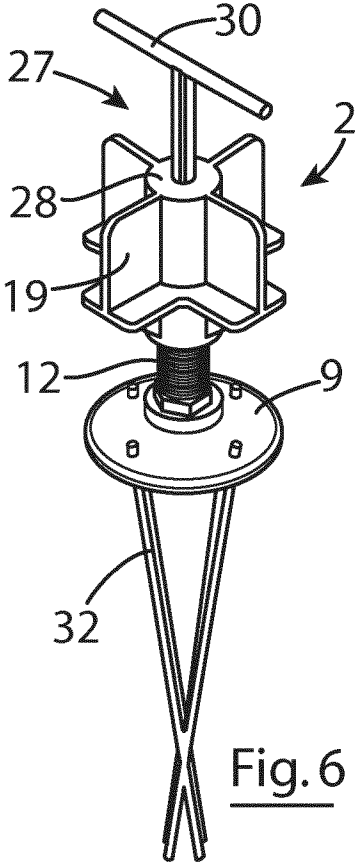
FIG. 6 is a perspective view from above and one side of a second embodiment of a support stand in which the support stand is provided with a tool-operated secondary beam carrier height adjustment mechanism for fine height adjustment and fixing rods are inserted through fixing rod holes defined in the circular base of the pedestal of the support stand.
Figure 8:
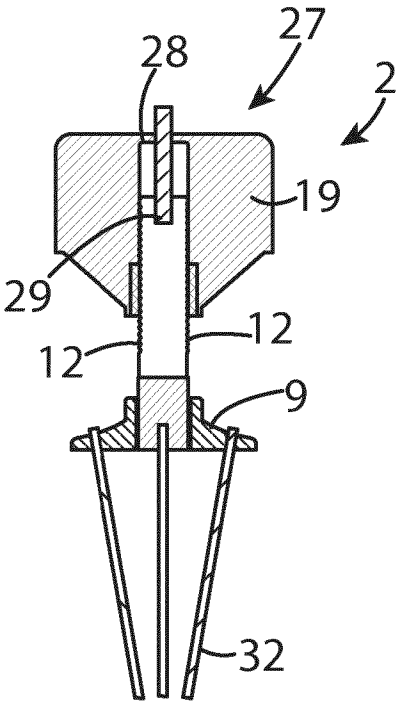
FIG. 8 is a longitudinal cross-section through the support stand with a portion of the adjustment tool omitted.
Figure 7:
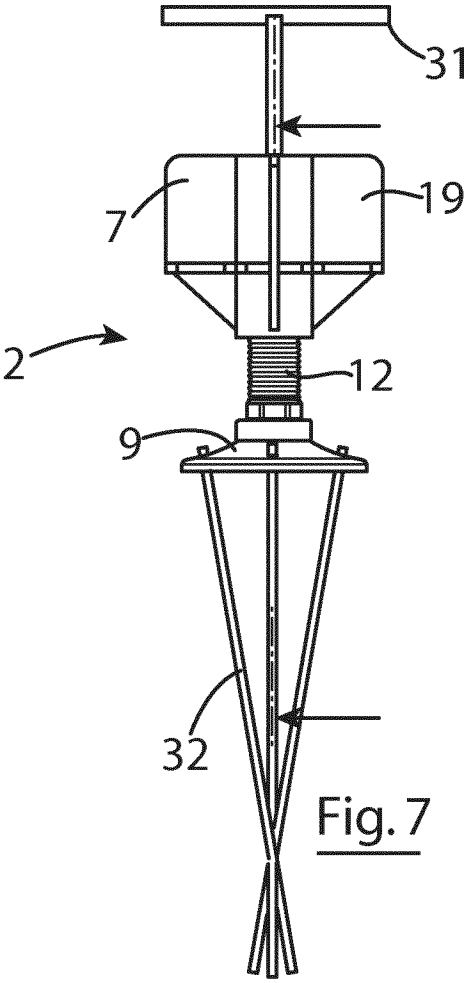
FIG. 7 is a side elevation of the support stand of FIG. 6.

FIGS. 6 to 8 show a second embodiment of a support stand 2 in accordance with the invention in which the support stand 2 is generally similar to the support stand 2 of FIGS. 1 to 5 but is also provided with a tool-operated secondary height adjustment mechanism 27 for fine height adjustment of the support stand 2. Like numerals indicate like parts.

The support stand 2 is provided with a tool access hole 28 defined in the central housing 22 of the beam carrier 7 to provide access to a tool receiving blind hole 29 defined in the top face of the threaded pillar 12. The tool access hole 28 and the tool receiving bind hole 29 are configured to receive a tool 30, in the form of a square ended tee wrench 30 in the present embodiment, so that rotation of the tee wrench 30 effects rotation of the threaded pillar 12 with respect to the sleeve insert 8 to finely adjust the height of the support stand 2. More particularly, turning of the tee wrench 30 in blind hole 29 causes the threaded pillar 12 to rotate with the base 9 and beam carrier 7 being fixed so that upwards and downwards adjustment will be equal to a difference in thread pitches i.e. 8.4666−6.0=2.4666 mm per revolution.

Accordingly, height adjustment is made possible by the use of two different thread pitches for the threads both right hand on either end of the threaded pillar 12. Accordingly, height change difference per revolution is reduced while mechanical advantage or lifting power is increased.

In the present embodiment, the support stand 2 is further provided with optional elongate fixing rods 32 inserted through the fixing rod holes 14 defined in the circular base 9 of the pedestal 6 of the support stand 2. The fixing rod holes 14 can be angled as required so that the fixing rods 32 converge. The fixing rods 32 can be formed from any suitable material such as steel or basalt fibre which can be driven/hammered down through the angled rod holes 14 in use.

FIGS. 9 to 12 show a third embodiment of the support stand 2 of the invention similar to the support stand 2 of FIGS. 1 to 5 but in which the wings 19 of the beam connectors 18 on the beam carrier 7 are extended or full-length wings 33 to maximise contact between the beam connectors 18 and structural beams 3. Like numerals indicate like parts. In order to maximise the length of the wings 33, the support ribs 23 and the housing bottom portion 24 are omitted so that the central 22 and the wings 33 of the wingnut like beam carrier 7 have a greater length.

Figure 9:
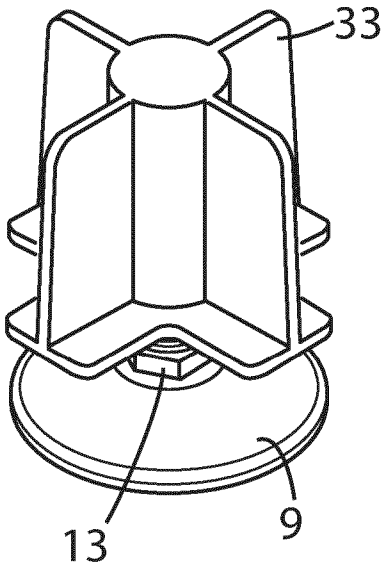
FIG. 9 is a perspective view from above and one side of a third embodiment of the support stand in which the web-like uprights or wings of the beam connector plates are extended or full-length uprights.
Figure 11:
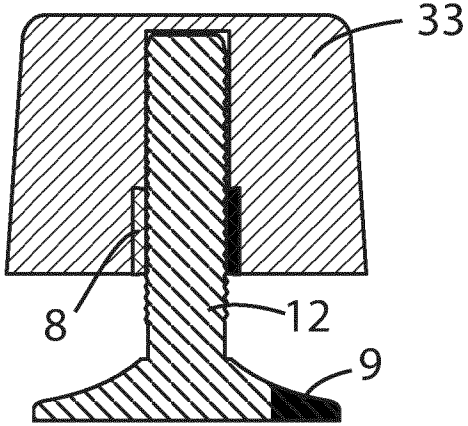
FIG. 11 is a longitudinal cross-section through the support stand of FIG. 10.
Figure 10:
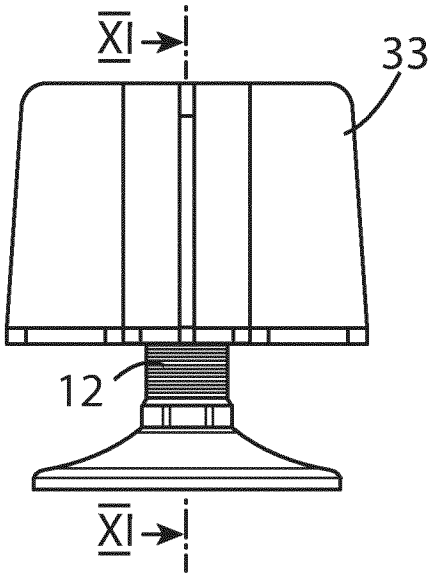
FIG. 10 is a side elevation of the support stand of FIG. 9.
Figure 12:
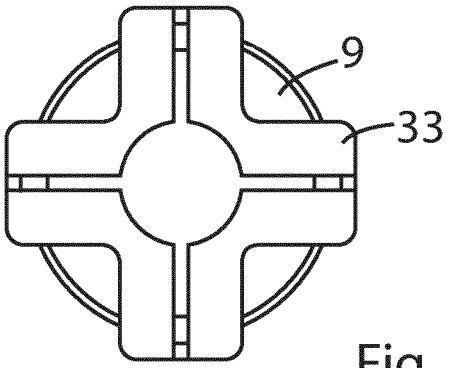
FIG. 12 is a top plan view of the support stand.
Figure 13:
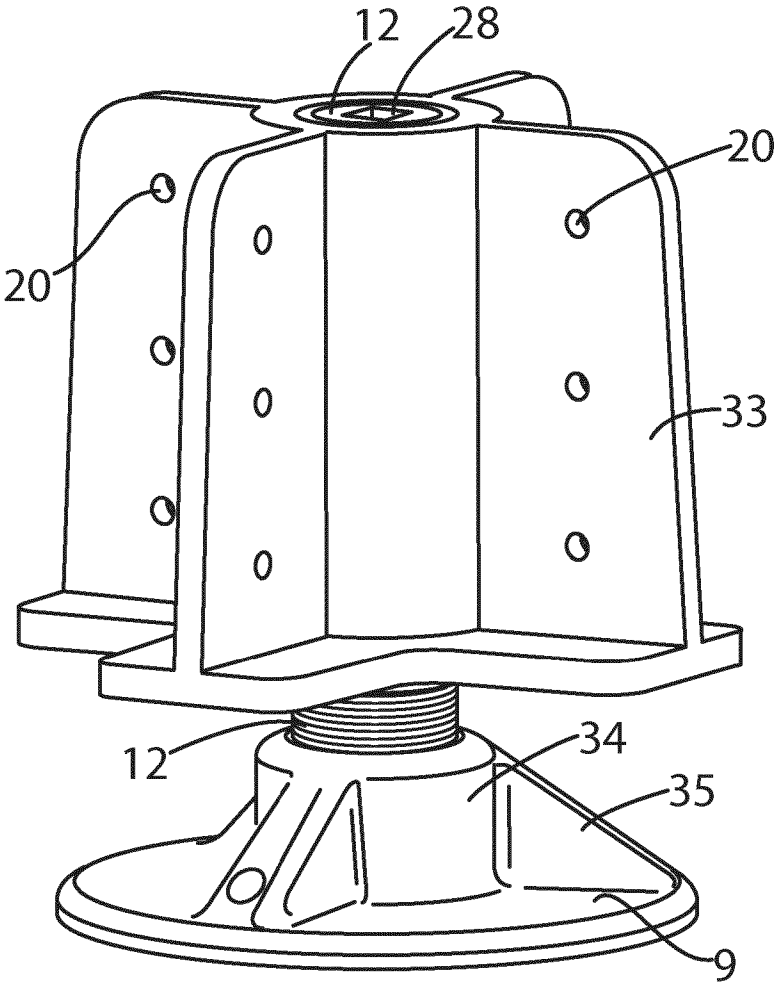
FIG. 13 is a perspective view from above and one side of a fourth embodiment of the support stand in which the support stand has full length beam connector uprights, a secondary beam carrier height adjustment mechanism and the base of the pedestal is provided with reinforcing support struts.

FIG. 13 shows a fourth embodiment of the support stand 2 broadly similar to the support stand 2 of FIGS. 6 to 8 and 9 to 12 but in which the support stand 2 has a secondary height adjustment mechanism 27 similar to the secondary height adjustment mechanism 27 of FIGS. 7 to 9 and the base 9 of the pedestal 6 is provided with a central boss 34 for receiving the threaded pillar 12 and reinforcing support struts 35 extending between the central boss 34 and the base 9. Like numerals indicate like parts.

This support stand 2 can be made from any suitable materials such as composite engineering polymers. A preferred polymer is Nyrim (Trade Mark) which can be optionally combined with additional nanoparticles to reinforce the support stand 2 or various fillers such as wollastonite (calcium inosilicate mineral ($CaSiO_3$)). Nyrim (Trade Mark) has a high flexural strength together with anti-fatigue properties so that fatigue failures normally associated with concrete and steel are eliminated.

The support stand 2 can be formed using known manufacturing techniques such as Reaction Injection Moulding (RIM) of the Nyrim (Trade Mark) polymer composite which is a repeatable process that the guarantees the consistency of the support stands 2.

FIGS. 14 to 27 show a fifth embodiment of the invention broadly similar to the embodiments previously described but in which the vertical uprights or wings 19 of the beam carrier 7 are substantially triangular in shape and the pad 9 has a cruciform shape. Like numerals indicate like parts. In the present embodiment, height adjustment is also made possible by the use of two threads having two different thread pitches, indicated by the reference numerals 52,53, both right hand on either end of the threaded pillar 12. Accordingly, height change difference per revolution is reduced while mechanical advantage or lifting power is increased.

FIGS. 28 to 31 show a beam carrier 7 of a sixth embodiment of the invention in which the beam carrier 7 is a T-shaped beam carrier when viewed from above i.e. is provided with three beam connectors 18 in the form of three web-like vertical uprights or wings 19 paced apart by 90°.

FIGS. 32 to 35 show a beam carrier 7 of a seventh embodiment of the invention in which the beam carrier 7 is an L-shaped beam carrier when viewed from above i.e. is provided with two beam connectors 18 in the form of two web-like vertical uprights or wings 19 spaced apart by 90°.

Figure 36:
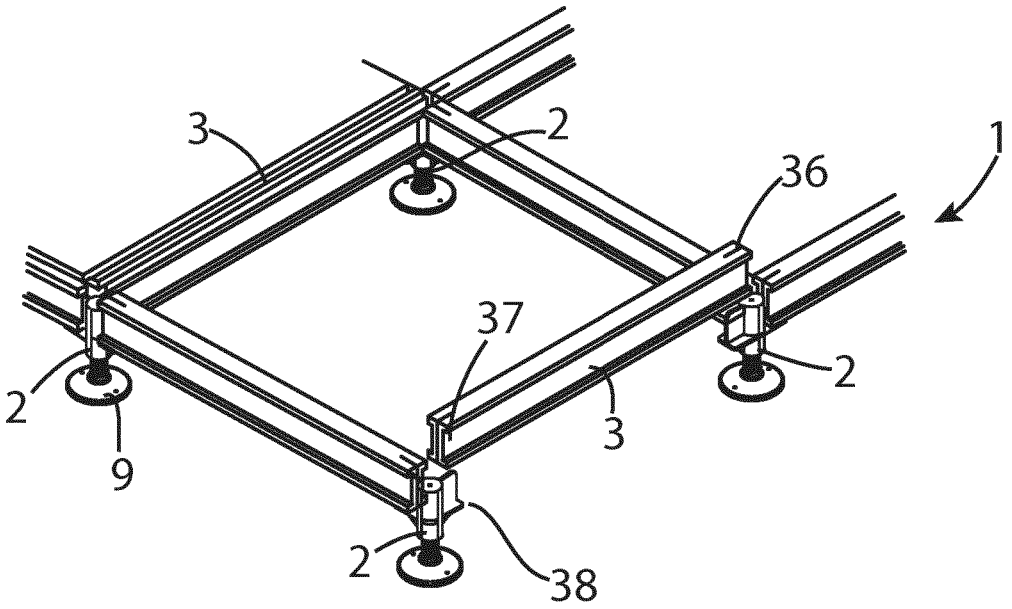
FIG. 36 is an enlarged perspective view from above and one side of the support stands and beams in the grid formation of FIG. 1.

FIG. 36 shows an enlarged perspective view from above and one side of the support stands 2 of FIGS. 1 to 5 and structural beams 3 in the grid formation of FIG. 1. As shown in the drawing, the structural beams 3 are provided with engineered or mortised ends 36 into which the wings 19 of the beam connectors 18 are received to connect the structural beams 3 to the support stands 2. The structural beams 3 are further provided with beam holes 37 at the mortised ends 36 through which beam fixings 38 such as bolts and the like can be inserted to secure the structural beams 3 to the support stands 2 by passing the fixings 38 through the corresponding fixing openings 20 defined in the wings 19 of the beam connectors 18.

Figure 14:
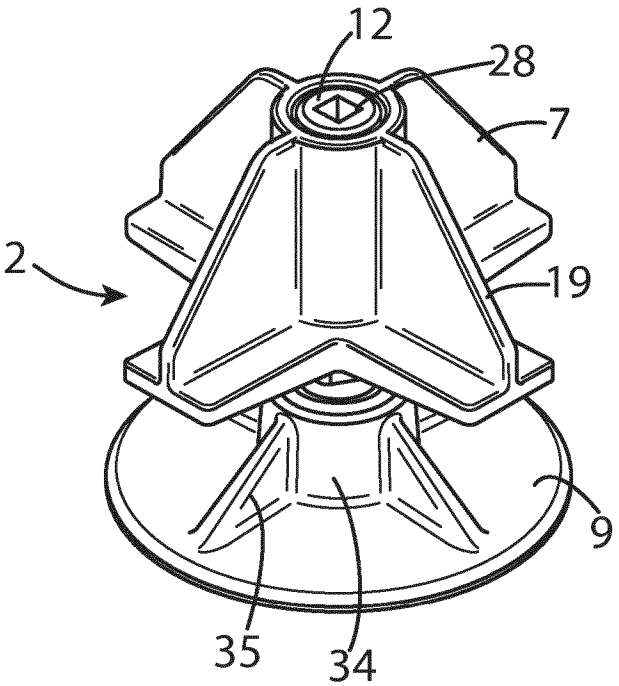
FIG. 14 is a perspective view from above and one side of a fifth embodiment of the invention similar to the embodiment of FIG. 13 but in which the vertical uprights or wings of the beam carrier are substantially triangular in shape.
Figure 15:
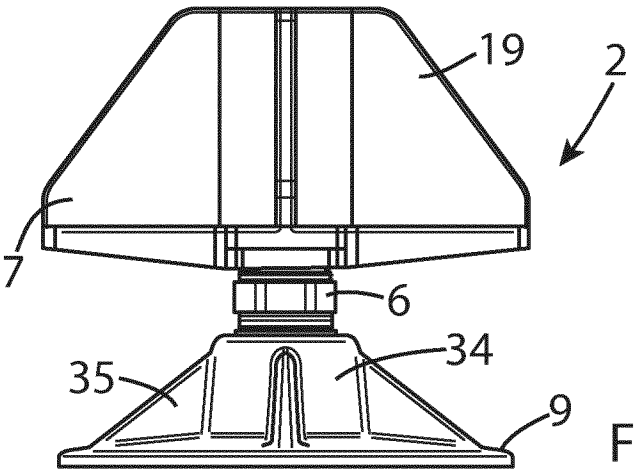
FIG. 15 is a side elevation of the support stand of FIG. 14.
Figure 16:
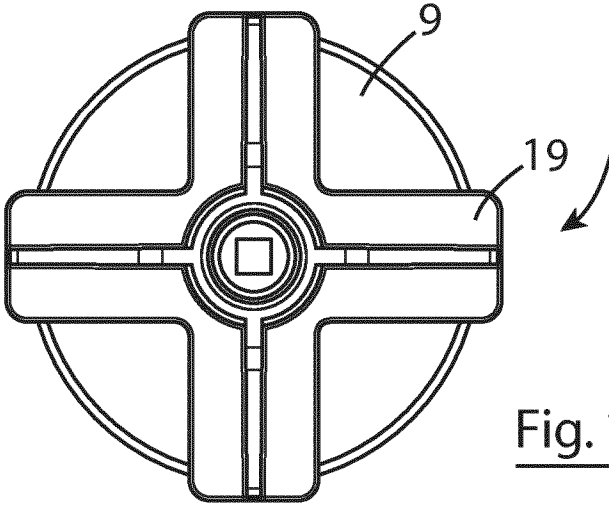
FIG. 16 is a top plan view of the support stand of FIG. 14.
Figure 19:
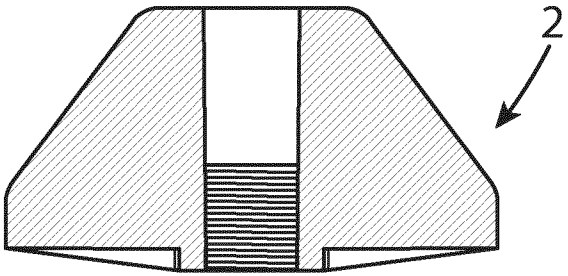
FIG. 19 is a cross-sectional view along the line XIX-XIX of FIG. 18.
Figure 17:
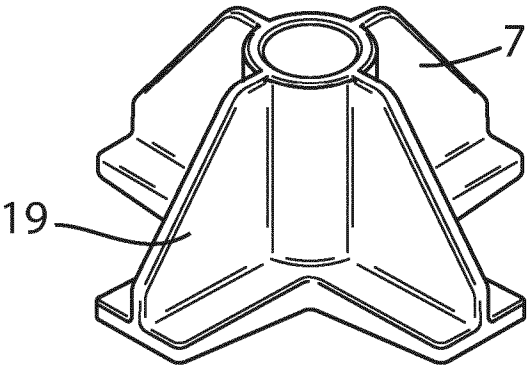
FIG. 17 is a perspective view from above and one side of the beam carrier of the stand of FIG. 14.
Figure 37:
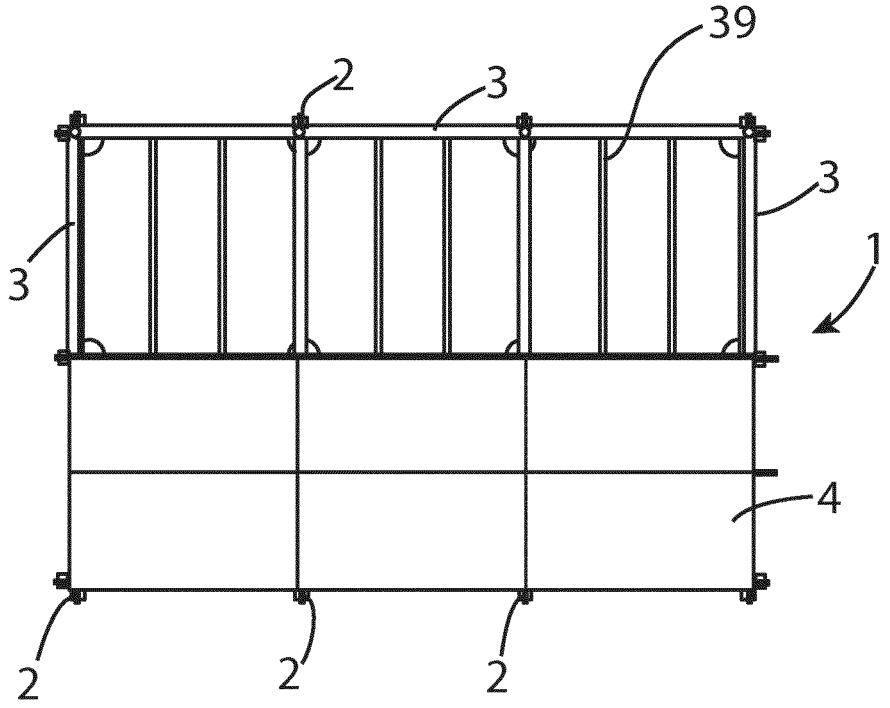
FIG. 37 is a top plan view of the grid formation of FIG. 36 with reinforcing trusses mounted between the beams and decks mounted on a portion of the grid formation.

FIG. 37 shows a top plan view of the grid formation of FIG. 14 with reinforcing trusses 39 mounted between the structural beams 3 and decks 4 mounted on a portion of the grid formation.

Figure 38:
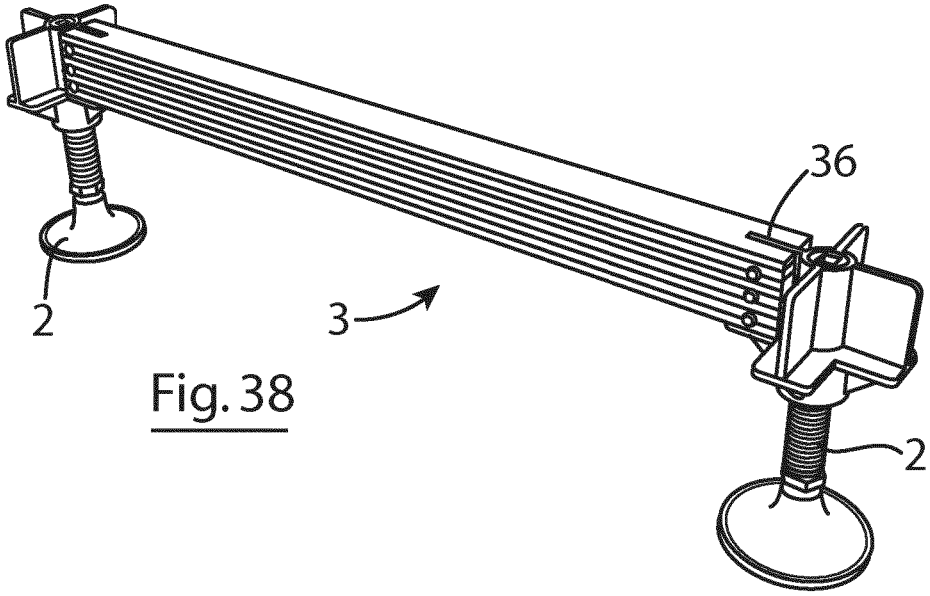
FIG. 38 is an enlarged perspective view from above and one side of two support stands of FIGS. 1 to 5 with a structural composite lumbar beam with mortised ends secured to the beam connectors of the support stands at the mortises.

FIGS. 38 to 41 show various types of structural beams 3 suitable for use in the foundation system 1 of the invention. More particularly, FIG. 38 shows an enlarged perspective view from above and one side of two support stands 2 of FIGS. 1 to 5 with a structural composite lumbar beam 3 with mortised ends 36 secured to the wingnut like beam connectors 18 of the support stands 2 at the mortised ends as described in FIG. 37. The structural composite lumbar beam 3 can be created by layering wood veneers or strands and bonding them with moisture-resistant adhesives to form structural framing members such as beams, studs, and columns. Such structural beams 3 provide numerous advantages over sawn conventional lumber, including higher strengths, dimensional stability, and resistance to moisture changes.

Figure 18:
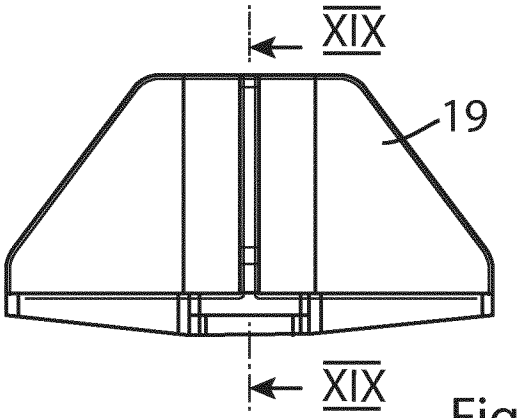
FIG. 18 is a side elevation of the beam carrier.
Figure 20:
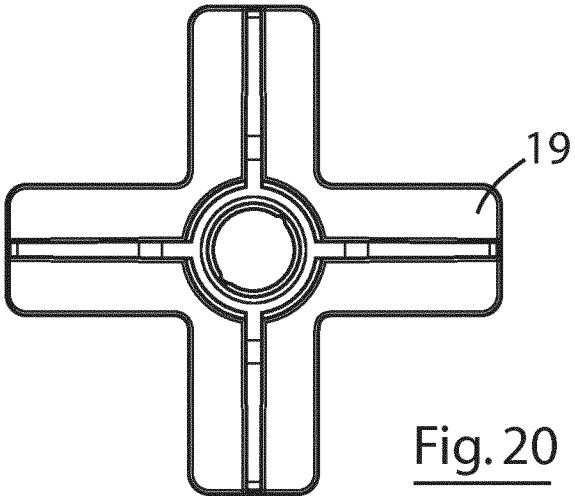
FIG. 20 is a top plan view of the beam carrier.
Figure 23:
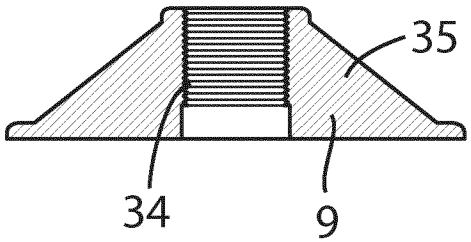
FIG. 23 is a cross-sectional view along the line XXIII-XXIII of FIG. 22.
Figure 21:
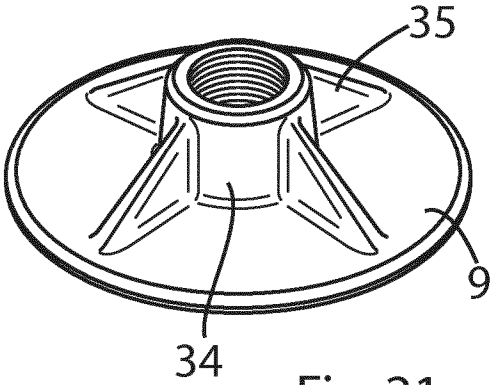
FIG. 21 is a perspective view from above and one side of the circular pad of the stand of FIG. 14.
Figure 22:
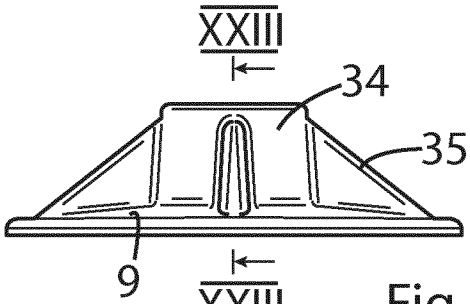
FIG. 22 is a side elevation of the circular pad.
Figure 24:
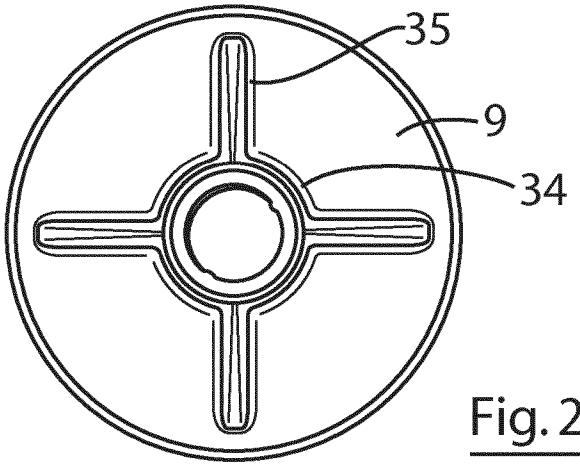
FIG. 24 is a top plan view of the circular pad.
Figure 25:
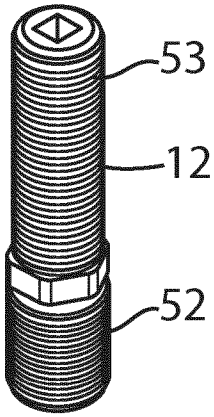
FIG. 25 is a perspective view from above and one side of the threaded pillar of the support stand of FIG. 14.
Figure 26:
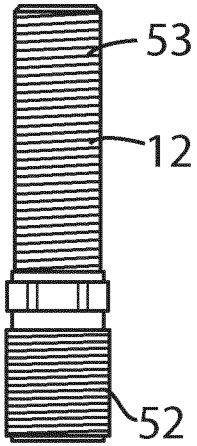
FIG. 26 is a side elevation of the threaded pillar of FIG. 25.
Figure 27:
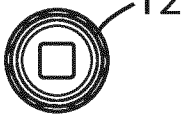
FIG. 27 is a top plan view of the threaded pillar.
Figure 30:
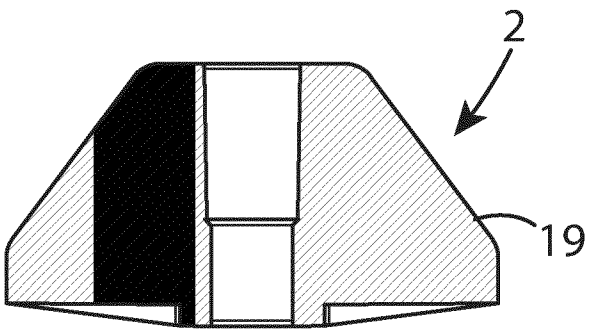
FIG. 30 is a cross-sectional view along the line XXX-XXX of FIG. 29.
Figure 28:
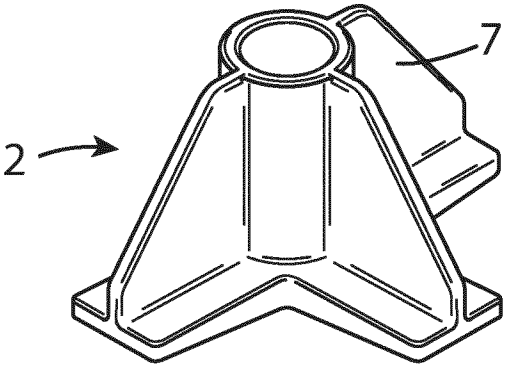
FIG. 28 is a perspective view from above and one side of a beam carrier of a sixth embodiment of the invention in which the beam carrier is a T-shaped beam carrier i.e. is provided with three beam connectors in the form of three web-like vertical uprights or wings spaced apart by 90°.
Figure 29:
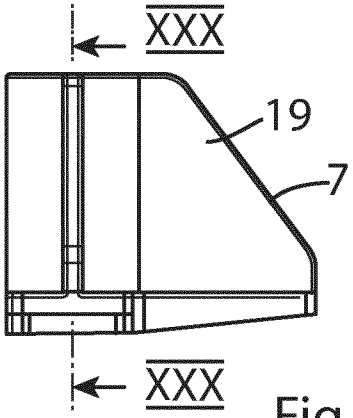
FIG. 29 is a side elevation of the beam carrier of FIG. 28.
Figure 31:
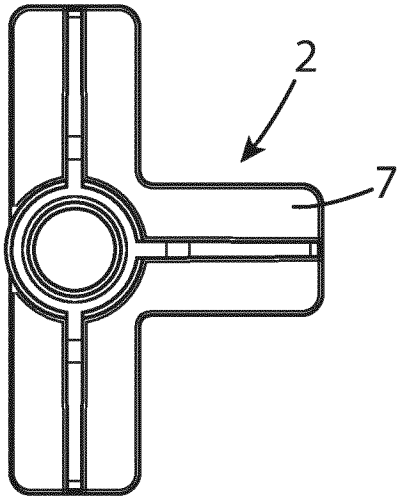
FIG. 31 is a top plan view of the beam carrier of FIG. 28.
Figure 32:
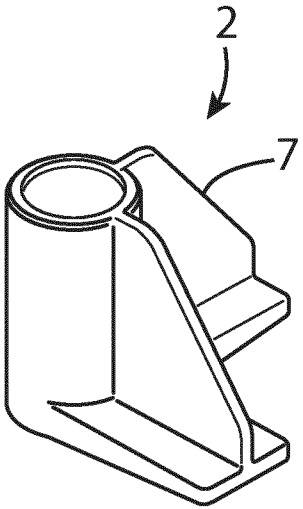
FIG. 32 is a perspective view from above and one side of a beam carrier of a seventh embodiment of the invention in which the beam carrier is an L-shaped beam carrier i.e. is provided with beam connectors in the form of two web-like vertical uprights or wings spaced apart by 90°.
Figure 34:
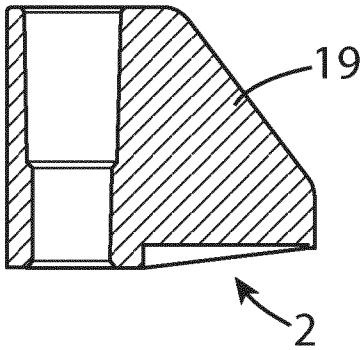
FIG. 34 is a cross-sectional view along the line XXXIV-XXXIV of FIG. 33.
Figure 33:
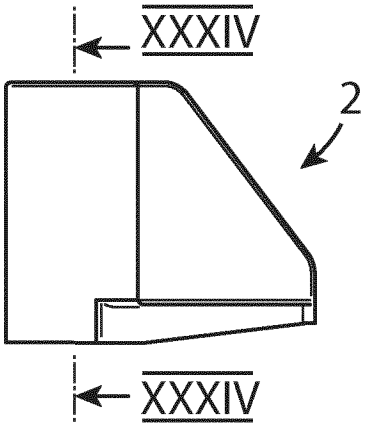
FIG. 33 is a side elevation of the beam carrier of FIG. 32.
Figure 35:
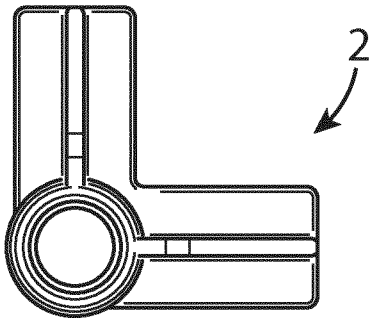
FIG. 35 is a top plan view of the beam carrier of FIG. 32.
Figure 39:
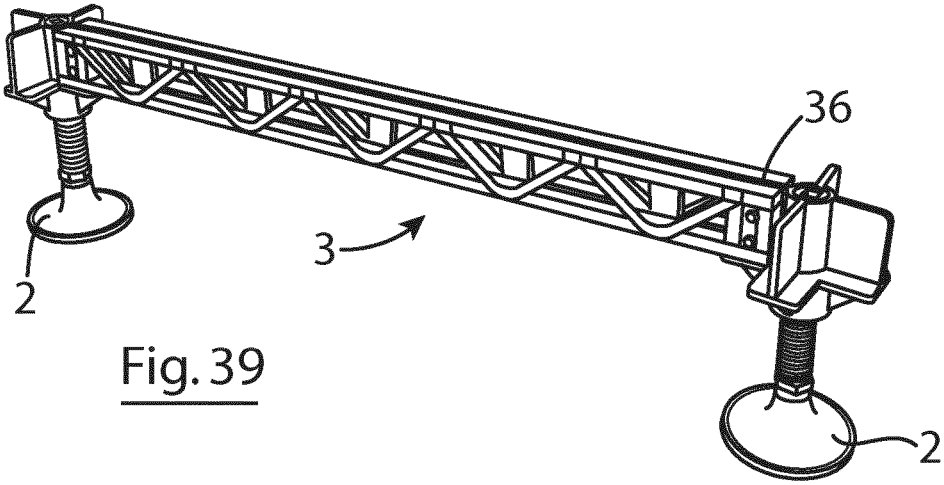
FIG. 39 is an enlarged perspective view from above and one side of two support stands of FIGS. 1 to 5 with a structural open web double beam with engineered ends secured to the beam connectors of the support stands at the engineered ends.

Similarly, FIG. 39 shows an enlarged perspective view from above and one side of two support stands 2 of FIGS. 1 to 5 with a structural open web double beam 3 with mortise-like engineered ends 36 secured to the beam connectors 18 of the support stands 2 while FIG. 18 shows an enlarged perspective view from above and one side of two support stands 2 of FIGS. 1 to 5 with a structural double I-beam 3 with mortise-like engineered ends 36 secured to the beam connectors 18 of the support stands 2.

Figure 40:
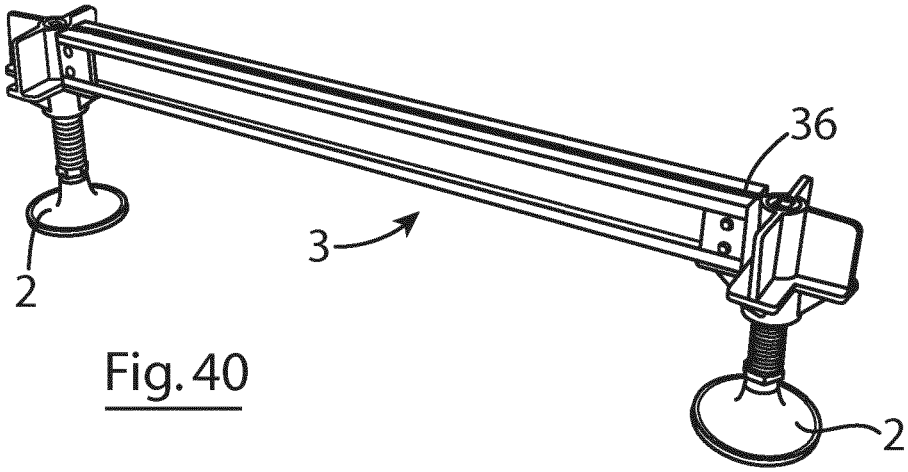
FIG. 40 is an enlarged perspective view from above and one side of two support stands of FIGS. 1 to 5 with a structural double I-beam with engineered ends secured to the beam connectors of the support stands at the engineered ends.
Figure 41:
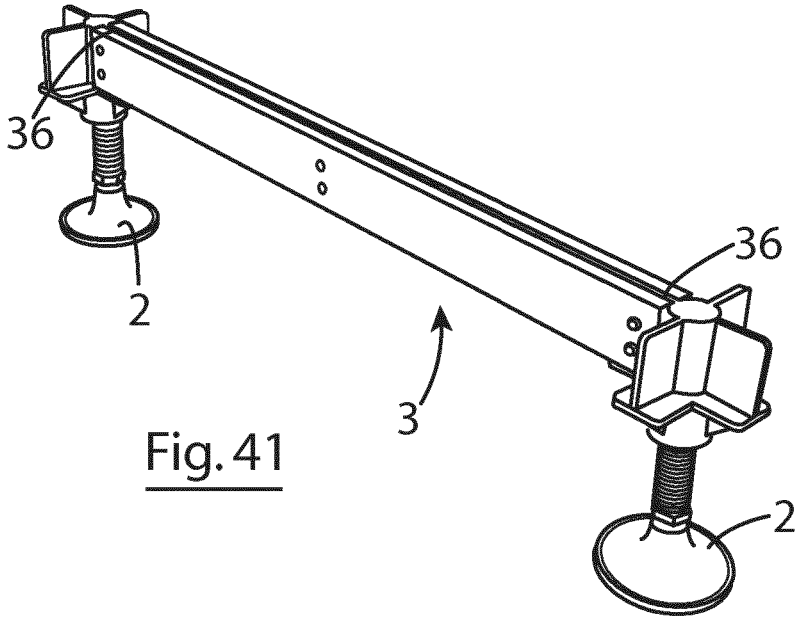
FIG. 41 is an enlarged perspective view from above and one side of two support stands of FIGS. 1 to 5 with a structural double timber plank/joist/fletch beam with engineered ends secured to the beam connectors of the support stands at the engineered ends.
Figure 42:
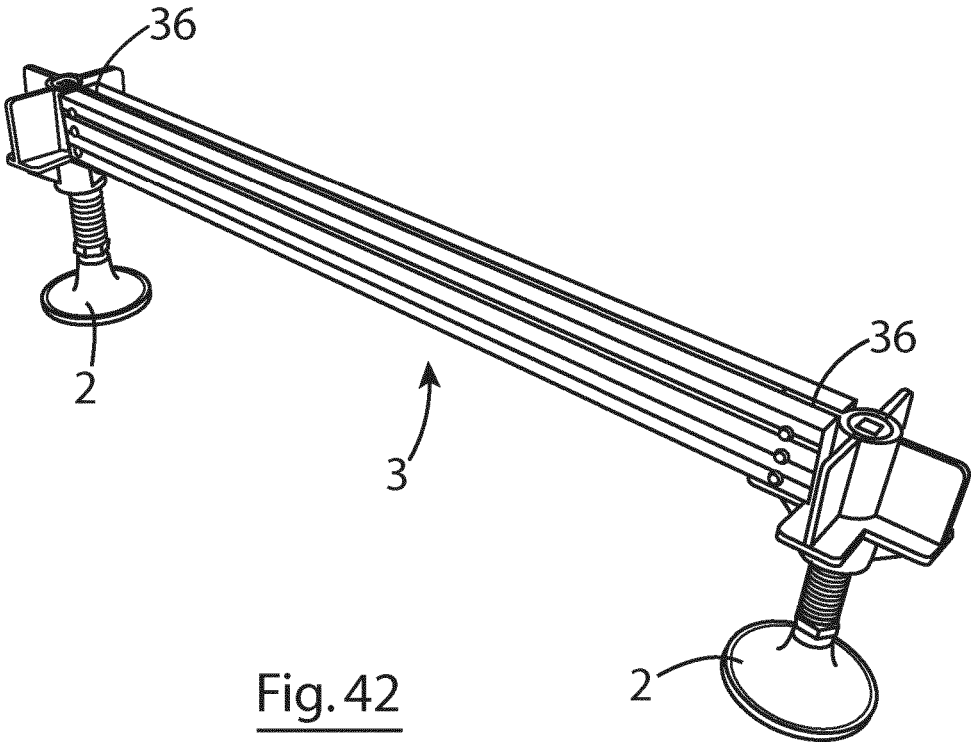
FIG. 42 is an enlarged perspective view from above and one side of two support stands of FIGS. 1 to 5 with a structural double light gauge steel beam with engineered ends secured to the beam connectors of the support stands at the engineered ends.

FIG. 40 shows an enlarged perspective view from above and one side of two support stands 2 of FIGS. 1 to 5 with an alternate structural beam 3 in the form of a structural double timber plank/joist/fletch beam 3 with mortise-like engineered ends 36 secured to the beam connectors 18 of the support stands 2 while FIG. 41 shows an enlarged perspective view from above and one side of two support stands 2 of FIGS. 1 to 5 with a structural double light gauge steel beam 3 with mortise-like engineered ends 36 secured to the beam connectors 18 of the support stands 2.

Figure 43:
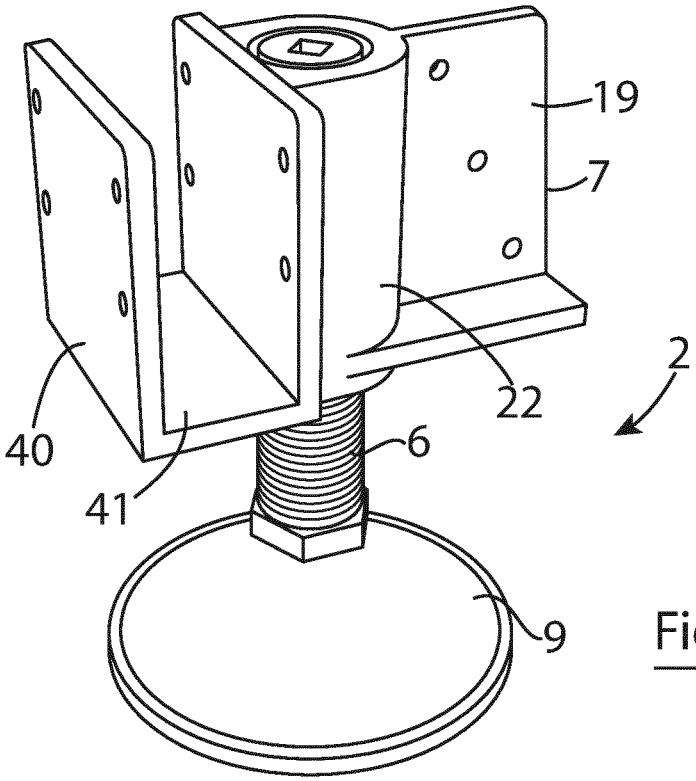
FIG. 43 a is perspective view from above and one side of an eighth embodiment of the support stand in which the support stand is provided with a beam carrier or connector in the form of an offset U-shaped or slot-like beam carrier for receiving a beam in an outside offset position with respect to the support stand.
Figure 44:
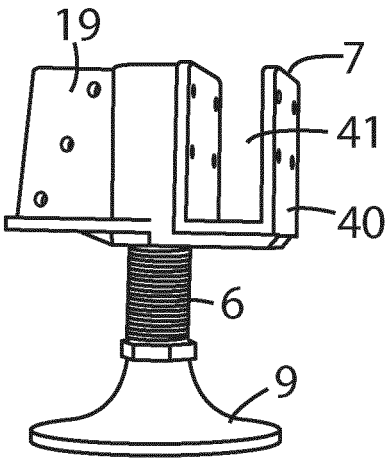
FIG. 44 is a side perspective view of the support stand of FIG. 43.
Figure 45:
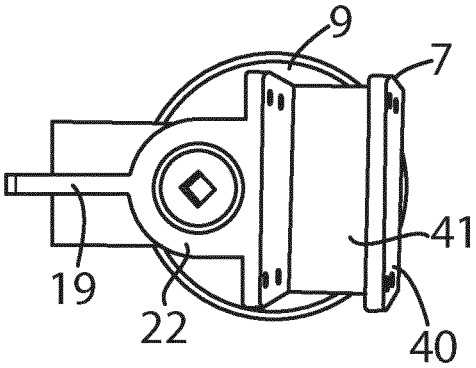
FIG. 45 is a perspective view from above of the support stand of FIG. 43.

FIGS. 43 to 45 show is perspective view from above and one side of an embodiment of the support stand 2 in which the support stand 2 is provided with a beam connector 18 in the form of an offset U-shaped or slot-like beam connector 40 for receiving a beam 3 in an outside offset position with respect to the support stand 2. Otherwise the support stand 2 is broadly similar to the support stand 2 of previous embodiments and like numerals indicate like parts. As shown in the drawings, the offset slot-like beam connector 40 is disposed opposite a web-like upright beam connector 19 as previously described and is made up of a U-shaped slot or channel 41 for receiving a beam 3. The U-shaped slot 41 is attached to the housing 22 and serves to receive a beam 3 in an offset manner in grid formations when combined with the support stands 2 of the embodiments described above as shown in FIGS. 27 to 30. Accordingly, as shown in the drawings, the offset slot-like beam connector 40 can receive and support single full length continuous beams at the perimeter of grid formations.

Figure 46:
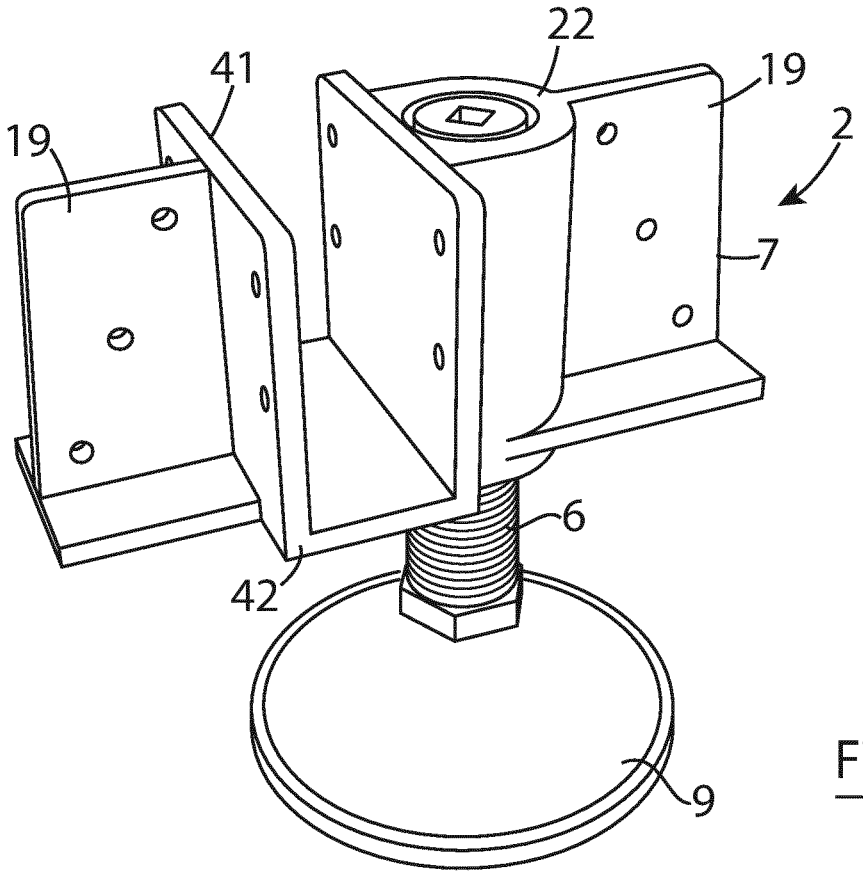
FIG. 46 is a is perspective view from above and one side of a ninth embodiment of the support stand in which the support stand is provided with a beam carrier in the form of an offset U-shaped or slot-like beam carrier for receiving a beam in an inside offset position with respect to the support stand.
Figure 47:
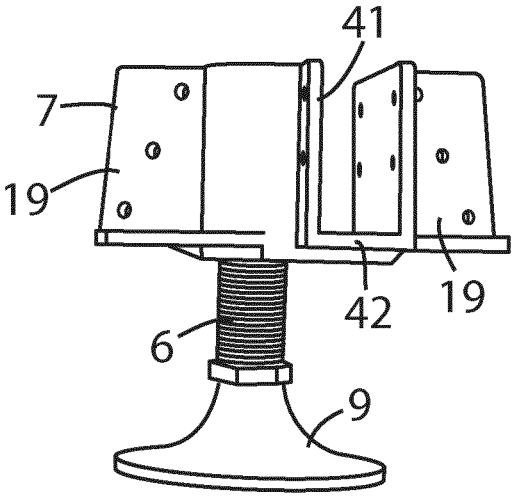
FIG. 47 is a side perspective view of the support stand of FIG. 46.
Figure 48:
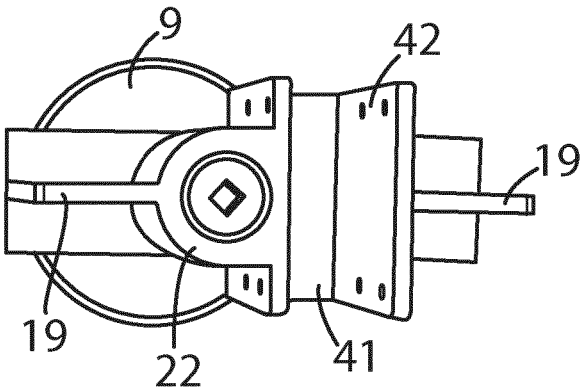
FIG. 48 is a perspective view from above of the support stand of FIG. 46.

FIGS. 46 to 48 show a perspective view from above and one side of an embodiment of the support stand 2 in which the support stand 2 is provided with a beam connector 18 in the form of an inside offset U-shaped or slot-like beam connector 42 for receiving a beam 3 in an inside offset position with respect to the support stand 2. The inside offset beam connector 42 is provided with a beam receiving slot 41 as previously described. However, in the present embodiment, while the inside offset beam connector 42 is also attached to the housing 22 opposite a web-like upright beam connector 19, the inside offset beam connector 42 is also provided with a wing or web-like upright beam connector 19 on its outer wall for connecting to beams 3. Accordingly, as shown in FIG. 52, the support stand 2 of the present embodiment can be employed to carry and support single full length inner beams 3 in grid formations.

Figure 50:
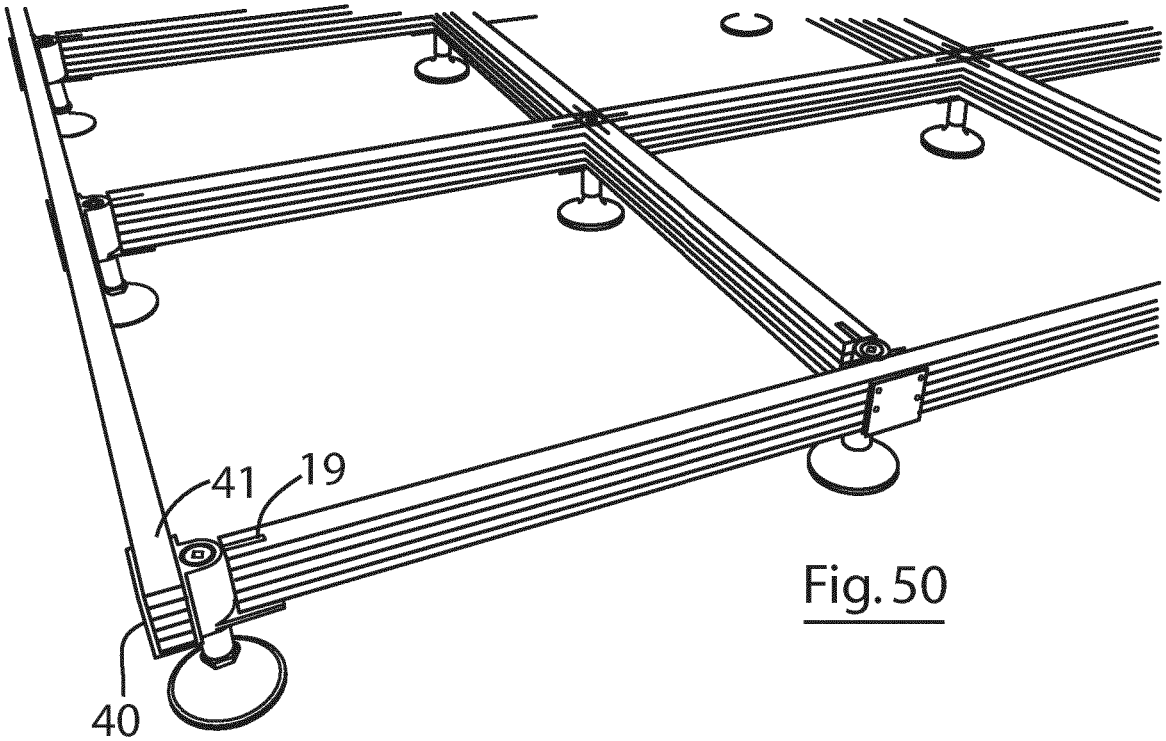
FIG. 50 is a perspective view from above and one side of the support stand of FIGS. 43 to 45 in combination with the support stand of FIGS. 1 to 5 in a grid formation.
Figure 49:
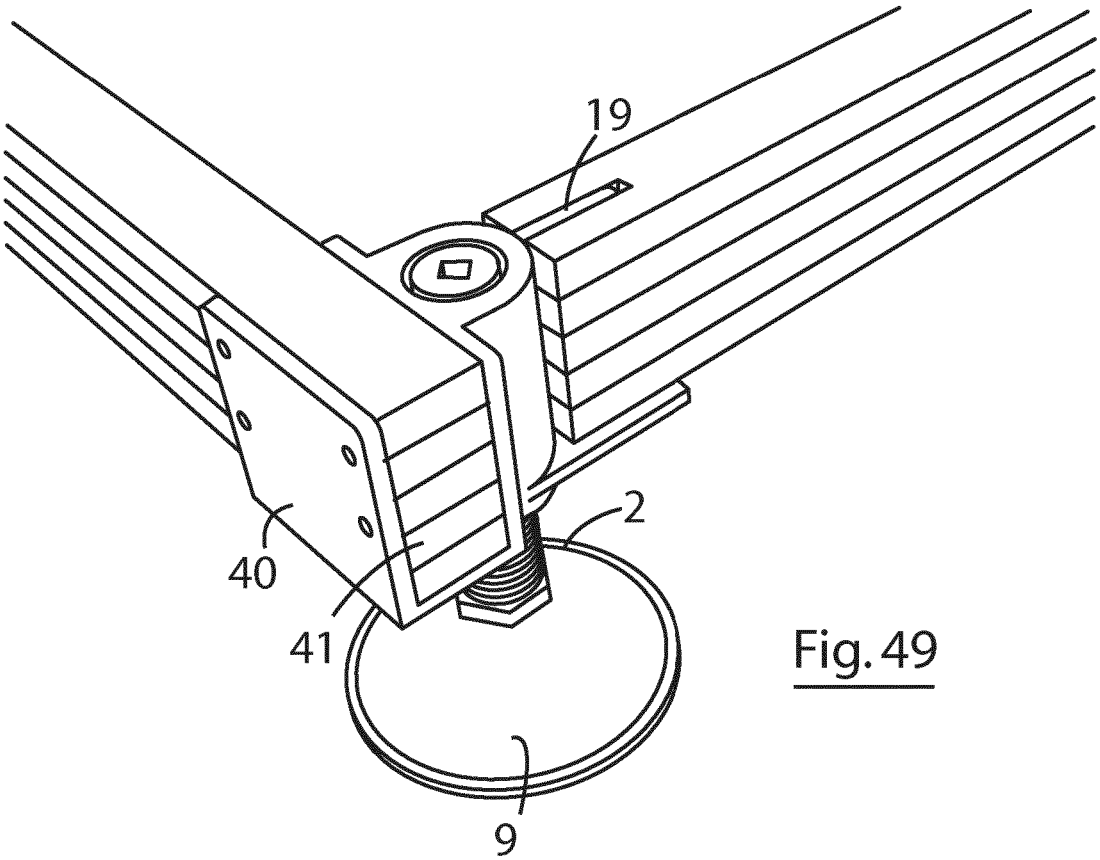
FIG. 49 is an enlarged perspective view from above and one side of the support stand of FIGS. 43 to 45 with beams supported in the web-like vertical wing and the slot-like beam carrier of the support stand.
Figure 51:
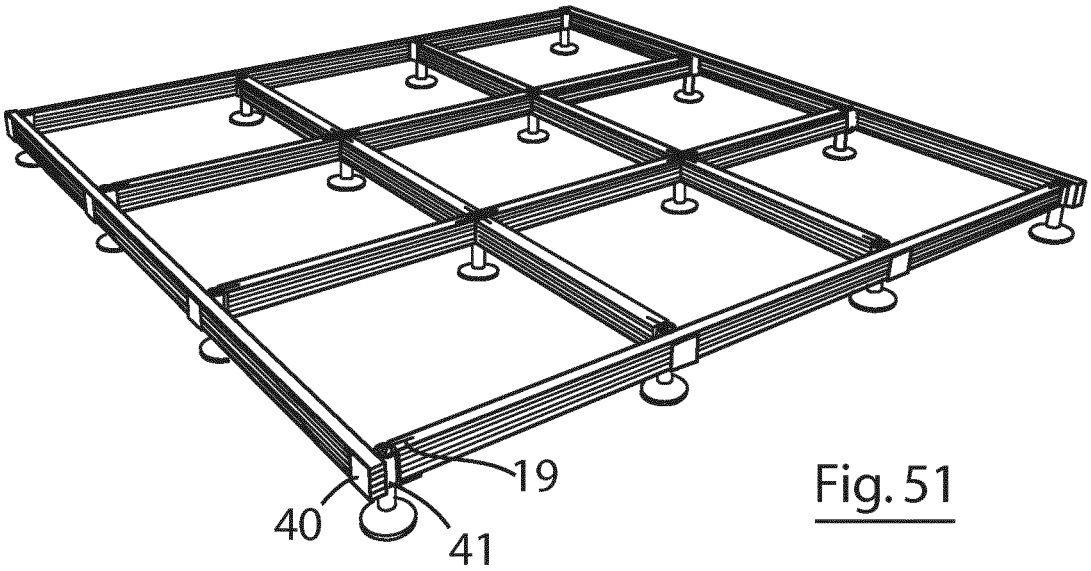
FIG. 51 is a perspective view from above and one side of the grid formation of FIG. 50.

FIG. 49 shows the support stand 2 of FIGS. 43 to 45 with beams 50 supported in the web-like vertical wing 19 and the slot-like beam carrier 41 of the support stand while FIGS. 50 and 51 show the support stand 2 of FIGS. 43 to 45 in combination with the support stand 2 of FIGS. 1 to 5 in a grid formation.

Figure 52:
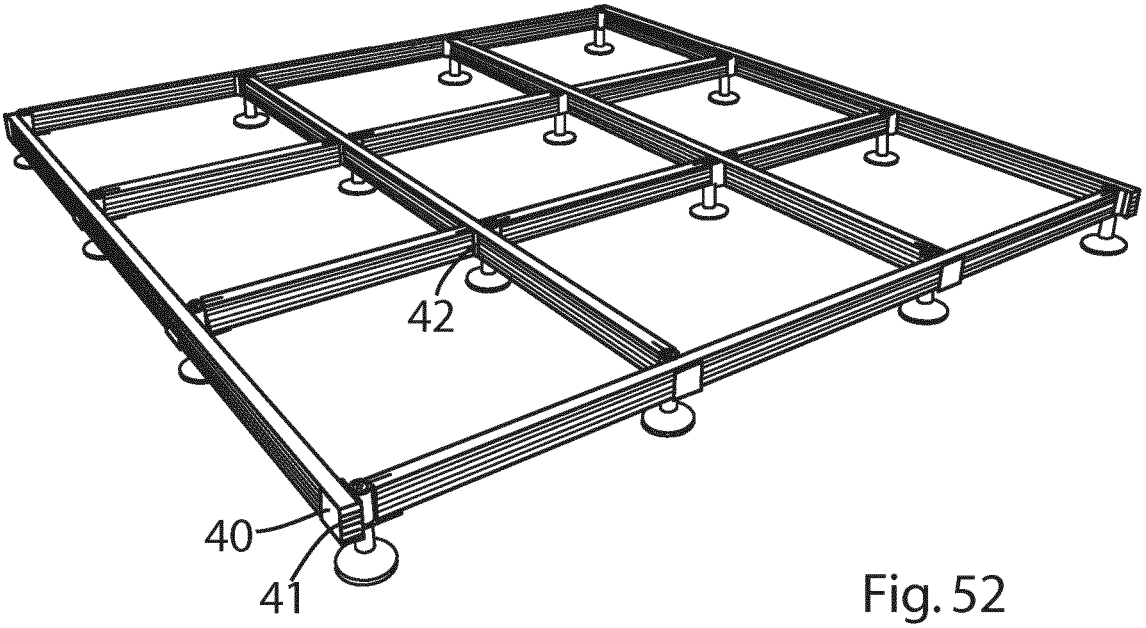
FIG. 52 is a perspective view from above and one side of a grid formation employing the support stands of FIGS. 1 to 5, FIGS. 43 to 45 and FIGS. 46 to 48 in combination.

FIG. 52 shows a grid formation employing the support stands of FIGS. 1 to 5, FIGS. 43 to 45 and FIGS. 46 to 48 in combination.

Figure 53:
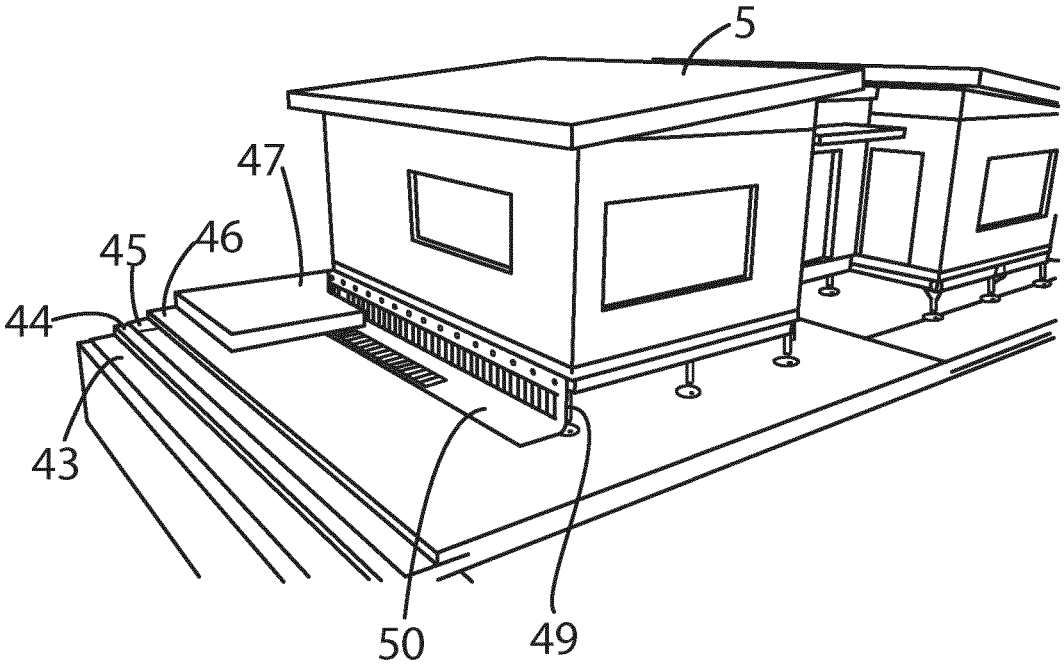
FIG. 53 is a perspective view from above and one side of a building constructed with the foundation system of the invention showing the various layers of the engineered ground employed with the foundation system and a plinth extending between the building and the engineered ground.
Figure 54:
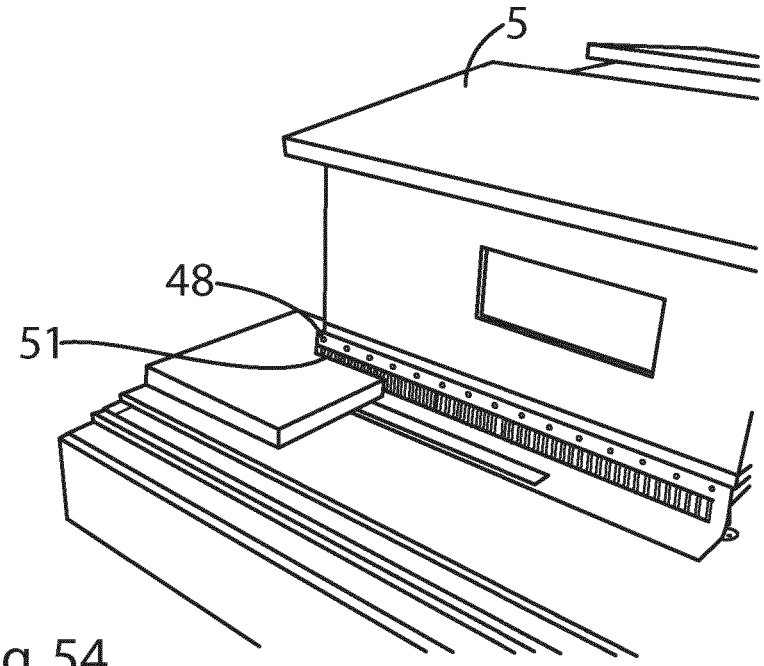
FIG. 54 is an enlarged perspective view from above and one side of the building, engineered ground and plinth of FIG. 53.

FIGS. 53 and 54 show a building 5 constructed with the foundation system 1 of the invention showing the various layers of the engineered ground employed with the foundation system 1. More particularly, the ground is engineered as required in accordance with ground conditions before deployment of the foundation system 1 of the invention. In general, the ground is engineered to a removed top soil level 40 and a first layer of compacted crushed stone 44 is placed on the removed soil level 43. If desired, an optional geogrid 45 can be placed on the first layer of compacted crushed stone to reinforce the ground. A second (fine) layer of compacted crushed stone 46 is then placed on the first layer 41 and/or the geogrid 42. The support stands 2 are then arranged in a grid formation on the second layer of compacted crushed stone 46 and the structural beams 3 are secured to the support stands 2 as previously described.

More particularly, the position for each support stand 2 is identified and marked out and each support stand 2 is then placed in its location and height adjusted as required with the primary height adjustment mechanism 26 as previously described. The structural beams 3 are then lifted into place on the support stands 2 and bolted together. Once all the structural beams 3 are bolted together the height of the support stands 2 can be finely level adjusted with the secondary height adjustment mechanism 26 or by adjusting the height adjustment nut 13 with a spanner. Once the structural beams 13 are all level, all connecting bolts can be tightened to recommended torque as required. Once the structural beams 3 are levelled and tightened to the support stands 2, the system 1 is self-aligning and the beam carriers 7 keep the grid formation parallel, perpendicular and aligned.

Finally, the decks 4 are secured to the structural beams to create a floor level on which the building 5 is constructed.

Once constructed, a footpath 47 can be laid around the building 5. Prior to laying the footpath 47, an optional apron-like plinth 45 can be attached to the outer structural beams 3 and/or decks 4 of the building 5 to tie the building to the ground. More particularly, the plinth 45 can be an L-shaped plinth 48 having a vertical wall 49 for attachment to the structural beams 3 and/or the decks 4 and a horizontal wall 50 for abutting the ground on which the footpath 47 can be paid to secure the plinth 48 and the building 5 in position. The vertical wall 46 can be provided with air vents 51 to allow for aeration beneath the building 5 and radon gas escape and the like.

The invention claimed is:

1. A foundation system for a building comprising:

a support stand attachable to a structural beam, the support stand comprising a threaded pillar and a beam carrier mounted on the threaded pillar wherein the beam carrier comprises a wingnut construction defining at least one substantially vertical wing connectable with a structural beam and the beam carrier is threadedly mounted on the threaded pillar to define a beam carrier height adjustment mechanism on the support stand so that the beam carrier is movable between a raised and lowered position by the beam carrier height adjustment mechanism and wherein the support stand further comprises a secondary beam carrier height adjustment mechanism accessible from above the support stand, wherein the foundation system further comprises at least one structural beam having two mortised ends at opposite ends of the at least one structural beam into which the vertical wings of the beam carrier are received, the mortised ends of the structural beam and the beam carrier being provided with cooperating beam holes and beam carrier holes through which beam fixings can be inserted to secure the structural beam to the beam carrier.

2. A foundation system as claimed in claim 1 wherein the beam carrier is threadedly mounted on the threaded pillar at an insert disposed between the beam carrier and the threaded pillar.

3. A foundation system as claimed in claim 1 wherein the support stand comprises two or more vertical wings disposed at 90° to each other.

4. A foundation system as claimed in claim 1 wherein the wing comprises the holes for receiving structural beam fixings.

5. A foundation system as claimed in claim 1 wherein the support stand comprises a composite polymer material.

6. A foundation system as claimed in claim 1 wherein the foundation system further comprises a deck for a floor structure.

7. A foundation system as claimed in claim 6 wherein the foundation system comprises an L-shaped plinth for tying structural beams or the floor structure to the ground.

8. A method for constructing a foundation comprising employing a foundation system as claimed in claim 1 in the construction of the foundation.

9. A foundation system as claimed in claim 1 wherein the secondary beam carrier height adjustment mechanism is accessed at a top face of the threaded pillar.

10. A foundation system as claimed in claim 9 wherein the beam carrier comprises a central housing defining a central bore for receiving the threaded pillar and the secondary beam carrier height adjustment mechanism is a tool-operable secondary beam carrier height adjustment mechanism comprising a tool access hole in the central housing providing access to a tool receiving hole in the threaded pillar.

11. A foundation system as claimed in claim 1 wherein the threaded pillar comprises different threads at each end of the threaded pillar and the secondary beam carrier height adjustment mechanism is a fine beam carrier height adjustment mechanism.

12. A foundation system as claimed in claim 11 wherein the different threads comprise different thread pitches.

* * * * *